252-103 AU 157 EX

11/27/84 XR 4,485,028

United States Patent [19]

King

[11] Patent Number: 4,485,028

[45] **Date of Patent: * Nov. 27, 1984**

[54] INORGANIC PERSULFATE CLEANING SOLUTION FOR ACOUSTIC MATERIALS

[75] Inventor: Jeffrey J. King, Orange, Calif.

[73] Assignee: Ceil Clean Corporation, Inc., Riverside, Calif.

[ * ] Notice: The portion of the term of this patent subsequent to Mar. 22, 2000 has been disclaimed.

[21] Appl. No.: 474,169

[22] Filed: Mar. 10, 1983

Related U.S. Application Data

[63] Continuation-in-part of Ser. No. 243,868, Mar. 16, 1981, Pat. No. 4,377,489.

[51] Int. Cl.[3] ..... C11D 3/08; C11D 7/56

[52] U.S. Cl. ..... 252/99; 134/2; 134/41; 252/95; 252/102; 252/103; 252/104; 252/174.16; 252/153; 252/158; 252/527; 252/532; 252/531; 252/DIG. 14

[58] Field of Search ..... 252/95, 97, 99, 102, 252/103, 104, 158, 173, DIG. 14, 153, 174.16, 527; 134/2, 3, 41

[56] References Cited

U.S. PATENT DOCUMENTS

| | | | |
|---|---|---|---|
| 2,742,434 | 4/1956 | Kopp | 252/106 |
| 2,962,448 | 5/1960 | Dvorkovitz et al. | 252/546 |
| 3,034,851 | 5/1962 | Dustman | 8/111 |
| 3,194,768 | 7/1965 | Lindner et al. | 252/186 |
| 3,367,878 | 2/1968 | Mankowich | 252/110 |
| 3,457,151 | 7/1969 | Kortejarvi | 204/130 |
| 3,515,673 | 6/1970 | Kersnar et al. | 252/546 |
| 3,560,389 | 2/1971 | Payne et al. | 252/527 X |
| 3,627,685 | 12/1971 | Lam | 252/100 |
| 3,658,712 | 4/1972 | Lindner et al. | 252/99 |
| 3,679,609 | 7/1972 | Castner | 252/527 |
| 3,726,800 | 4/1973 | Yelin et al. | 252/95 |
| 3,773,673 | 11/1973 | Jenkins et al. | 252/95 |
| 3,817,875 | 6/1974 | Bazan | 252/527 |
| 3,832,309 | 8/1974 | Foster et al. | 252/527 |
| 3,840,481 | 10/1974 | Miller | 252/546 |
| 3,850,831 | 11/1974 | Hellsten et al. | 252/99 |
| 3,954,498 | 5/1976 | Flowers | 134/2 |
| 4,097,395 | 6/1978 | Posey et al. | 252/106 |
| 4,164,477 | 8/1979 | Whitley | 252/99 |
| 4,203,872 | 5/1980 | Flanagan | 252/542 |
| 4,298,492 | 11/1981 | van den Brom | 252/97 |
| 4,377,489 | 3/1983 | King | 252/99 |

OTHER PUBLICATIONS

Ammonium, Potassium and Sodium Persulfates–Technical Bulletin 1, FMC Corp.; Document No.: 0531CG2781.

*Primary Examiner*—Prince E. Willis
*Attorney, Agent, or Firm*—Willie Krawitz

[57] ABSTRACT

A stable, cleaning solution for acoustic materials, and the like, such as porous tile, fabric, etc., is disclosed that contains an inorganic oxidizer of ammonium persulfate as the active ingredient in the solution, that may be applied by spraying. Potable tap water is used as the diluent, and various ingredients are utilized in the cleaning solution to clean the tile and maintain the solution as a clear, single phase having a relatively long term activity life of about 5–10 days, at a pH typically at least about 8–9.

12 Claims, No Drawings

INORGANIC PERSULFATE CLEANING SOLUTION FOR ACOUSTIC MATERIALS

BACKGROUND OF THE INVENTION

This invention is a continuation-in-part of U.S. Ser. No. 243,868, filed Mar. 16, 1981, U.S. Pat. No. 4,377,489.

This invention relates to acomposition and process for cleaning acoustic materials, which may include porous cellulosics such as acoustic ceiling title, wood fiber matrices, blown acoustic mineral matrices comprising perlite combined with white portland cement, cement and lime, fabrics, painted acoustic surfaces, vinyl and plastic materials, cork, mineral fibers and mineral wool, plastic coated metals, metals, and the like.

Cleaning solutions that are presently employed to clean these acoustic materials contain usually a solution of chlorine bleach or other solutions that contain releasable chlorine as the active ingredient. Obviously, a cleaning solution is desired that can function in a manner similar to chlorine but without the dangerous side effects. If chlorine could be eliminated, the cleaning operation would be safer and would require fewer regulations.

Alkali metal persulfates, particularly ammonium persulfate, are well known as water soluble oxidizing agents, and their aqueous solutions are relatively stable when used alone. However, when used in conjunction with many common organic ingredients, the persulfate decomposes over a fairly short period, following solution make-up. The solution stability should be long enough to allow a work crew sufficient flexibility in the cleaning operation without being concerned about the cleaning solution losing its strength over a short period of time.

It would be preferable, on a long term basis, to be able to store the oxidizer, in this case the persulfate, in the solid dry form. This would increase the oxidizer storage life considerably, compared to storing a solution. Furthermore, if the persulfate can be transported as a dry solid instead of a liquid, and if the dirt removing portion of the cleaning solution can be shipped as a concentrate, this would save shipping costs.

THE INVENTION

According to the invention, a cleaning solution and method for cleaning acoustic materials is provided containing one or more alkali metal or ammonium persulfates as the active oxidizing ingredient. This solution is much safer to use than chlorine and is equivalent in cleaning effectiveness compared to solutions containing chlorine bleach or releasable chlorine.

Suitable inorganic persulfates that are used include ammonium persulfate $(NH_4)_2S_2O_8$, potassium persulfate $KSO_5$, $K_2S_2O_8$, and, sodium persulfate $NaSO_5$, $Na_2S_2O_8$. The ammonium persulfate is preferred due to its relatively low cost and high and rapid water solubility. About 2.0%–10% of the ammonium persulfate may be employed, and a range of about 5.0%–7.0% is preferred. All percentages herein refer to parts by weight of the final cleaning solution used for application onto the acoustic material, such as by spraying. The solution has a reasonably long term stability period of about 5–10 days, depending on the water purity and storage temperature.

Initially, the cleaning solution is made up in two portions, one portion containing the oxidizing persulfate.

The other portion containing various dirt dissolving compounds, a caustic pH adjusting agent, and stabilizing compounds, is quite stable and relatively free of particulate matter such as precipitates, crystallization, colloidal materials, and the like. The dirt dissolving portion of the solution thus has a relatively long term storage life, and this property enables it to be readily formulated at a factory as a concentrate, shipped and then stored. The final cleaning solution is produced by mixing appropriate amounts of persulfate and dirt dissolving concentrate with water.

The stability of the cleaning solution of this invention is quite surprising since a technical bulletin published by FMC Corporation concerning ammonium persulfate advises that the dry persulfate shoud not contact solvents, oils, greases and oxidizable organic compounds; the FMC bulletin also states that a solution of ammonium persulfate should not contact strong caustic solutions. Notwithstanding the FMC bulletin, the cleaning solution of this invention containing persulfate can be stabilized in the presence of a variety of organic compounds including solvents, emulsifiers, surfactants, and also caustic solution, and be utilized to safely remove greases, dirt, stains, and so forth.

DESCRIPTION OF THE PREFERRED EMBODIMENTS

Since many impurities may be contained in tap water that could catalyze the decomposition of ammonium persulfate, or otherwise reduce its effectiveness, these compounds should be either eliminated or neutralized. Such compounds include bacteria in concentrations that would render the water non-potable, ions such as $Ca^{+2}$, $Mg^{+2}$, etc., that will react with the cleaner to precipitate alkali or other solution components, or $Cu^{+2}$ ions that are potent catalysts for the decomposition of the persulfate. Usually, if a solution of potable tap water is employed, the problem of bacterial reaction with the persulfate will be minimized. Use of a chelating agent such as a nitriloacetic acid derivative will reduce the effect of hard water ions; usually, a concentration of about 0.03%–0.3%, and preferably about 0.05%–0.1% will be effective. A preferred chelating agent is hydroxyethyl ethylene diamine triacetic acid tri-sodium salt that is sold by the Dow Chemical Co. as "VERSENOL 120", and by Hampshire Chemical Division of W. R. Grace Co. as "HAMPOL 120". The VERSONOL 120 or HAMPOL 120 appear to aid in the removal of tobacco residue stains more effectively than the commonly used "VERSONAL 100" (Dow Chemical Co.) which is ethylene diamine tetra acetic acid tetra sodium salt. In general, also suitable are the alkali metal, ammonium and organic amine salts of polyamino-carboxylic acids, for example, the mono, di, tri and tetrasodium salts of ethylene diamine tetraacetic acid and diethylene tri amine pentaacetic acid, salts of oxycarboxylic acids, such as citric acid and gluconic acid, polyitaconic acid and polyacrylic acid. Other suitable nitriloacetic acid derivatives include: trans-1,2-diamino-cyclohexane tetra acetic acid monohydrate; α-glucoheptonic acid, diethylene triamine pentaacetic acid; benzo triazole; and, ethanal diglycine disodium salt.

An inorganic soil suspender is used to produce a suspention of solids that are removed from the acoustic material; this minimizes formation of a thick residue that tends to be impervious to an oxidizer because of its thickness. Preferred soil suspenders include alkali metal phosphates such as pentasodium tripolyphosphate, sodium acid tripolyphosphate, pentapotassium tripolyphosphate, tetrasodium and tetrapotassium pyrophosphate, sodium tetraphosphate, Na or K hexametaphosphate, and pentammonium tripolyphosphate. Other suitable soil suspenders include alkali metal silicates, aluminates, borates and carbonates. Polyacrylic acid polymers and polyarylamides also are useful. Typical soil suspender concentrations vary from about 0.1%–4.0%, and preferred concentrations vary from about 0.2%–0.5%.

It should be appreciated that there is an overlapping between some types of soil suspenders and chelating agents, and the demarcation between these classes is not always clear-cut. For example, inorganic polyphosphates also function both as water softening agents (i.e. chelating agents) and as soil suspenders.

A hydrotrope is employed in the dirt dissolving solution to maintain this solution as a single phase and also to stabilize the cleaning solution formed by combining the oxidizing agent and the dirt dissolving solution. A preferred hydrotrope may be a (Na, K, or ammonium) toluene or xylene sulfonic acid salt, phosphate ester surfactant, or mixtures thereof. Typical phosphate ester surfactants include: Triton H-55 and H-56 sold by Rohm & Haas; Alkaphos QC sold by Alkaril Chemicals; Gafac RP-710 sold by GAF Corporation; and T-Mulz 734, 734-2, 598 and 5984 sold by Thompson-Hayward Chemical Co. Other hydrotropes include: tetrasodium-N-(1,2-discarboxyethyl -N-octadecyl sulfosuccinamate and disodium ethoxylated nonyl phenol half ester of sulfosuccinic acid, and sold by American Cyanamid. The hydrotrope may be used in the cleaning solution at a concentration range broadly speaking of about 0.5%–3.0%, and preferably about 0.8%–1.3%.

Cleaning compounds such as surfactants or emulsifiers are used to emulsify dirt particles that remain on the acoustic material after an initial physical cleaning such as by vacuuming, brushing, etc. The surfactant or emulsifier is non-reactive with the persulfate and is preferably one or more of: ethoxylated alkyl phenols including octyl or nonyl phenols, ethoxylated fatty acid esters, ethoxylated alcohols, fatty acid sulfates, ether sulfates, and mixtures thereof. When an emulsifier is employed in conjunction with a surfactant, a suitable type that may be used is polyethylene glycol 400 sesquioleate, sold by Emery Industries, Inc. as "EMEREST 2647". Other suitable detergents include the anionic detergents such as soap, alkylaryl sulfonates, alkyl sulfates, alkane sulfonates, olefin sulfonates, fatty acid isethionates and fatty acyl taurides. Nonionic, zwitterionic and cationic detergents that are substantially unaffected in solution by the bleaching agents can also be employed. A concentration range of about 0.5%–4.0% of the surfactant and/or emulsifier in the cleaning solution is useful, and preferably, about 0.5%–1.5% is used.

A water miscible solvent is used to dissolve organic components in the dirt. Typical solvents include isopropyl alcohol, acetone, ethyl alcohol, ethyl and butyl monoesters of ethylene glycols, methyl ethyl ketone, etc. The solvent and detergent are coupled by the hydrotrope, the latter also coupling the aqueous phase with the non aqueous phase of the dirt dissolving solution. About 1.0%–6.0%, and preferably about 1.5%–3.5% of the solvent is employed in the cleaning solution.

A base such as NaOH or KOH is added to the dirt dissolving solution in a sufficient amount so that the pH of the cleaning solution will be adjusted to about 8–9; this optimizes the activity of the ammonium persulfate, and prevents the odor of ammonia. When using ammonium persulfate, a typical concentrate solution pH when formulated at the factory is about 13–14. Usually, the KOH concentration in the cleaning solution, as opposed to the concentrate may vary from about 1%–6%, but this range can vary widely, depending on the choice of the ingredients. If the ammonia odor is not objectionable, or if a persulfate other than ammonium persulfate is used, the pH may be increased to about say, 9–11. This will increase the persulfate activity somewhat, but will shorten the useful life of the cleaning solution, and will slightly increase the potential skin hazard to the user. An excess of KOH or NaOH may be used to supplement the activity of the solvent.

Examples of compositions of this invention are shown as follows:

| EXAMPLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|
| ALKALI PERSULFATE (5%–7%) | | | | | | | | | | | | | | | | | | | | | | |
| TRI SODIUM PHOSPHATE | | | | | | | | | | | | | | | | | | | | | | |
| SODIUM TRIPOLY-PHOSPHATE | | 0.5 | 0.5 | | | | | | | | | | 0.2 | | | | | | 0.4 | | | |
| TETRAPOTASSIUM PYROPHOSPHATE | | | | 0.2 | 0.2 | 0.2 | 0.2 | 0.2 | 0.2 | 0.2 | 1.4 | 3.3 | | | 0.1 | 0.2 | | 0.1 | | 0.2 | 0.2 | 0.2 |
| SODIUM HEXAMETA-PHOSPHATE | | | | | | | | | | | 1.4 | | | | 0.1 | | | | | | 0.1 | |
| SODIUM META SILICATE | 0.3 | | | | | | | | | | | | | | | | | | | | | |
| SODIUM CMC | .02 | | | | | | | | | | | | | | | 0.02 | | | | | | |
| $Na_4EDTA$ | .05 | | | .06 | | | | | | | | | | | | | | | | | | |
| $Na_3HEDTA$ | | | | | .06 | .06 | .06 | .06 | .06 | .06 | | | .06 | .06 | .06 | .06 | | | | | | 0.6 |
| BENZOTRIAZOLE | | | | | | | | | | | | | | | | | | | | | .03 | .03 |
| Na NITRITE | | | | | | | | | | | | | | | | | | | | | .02 | .03 |
| Na BENZOATE | | | | | | | | | | | | | | | | | | | | | .02 | .03 |
| SODIUM XYLENE SULFONATE | 0.4 | 0.4 | 0.5 | 0.9 | 0.5 | 0.7 | 0.9 | 0.9 | 0.9 | 0.9 | | | 0.9 | 0.9 | 0.9 | 0.9 | 0.9 | 0.9 | 0.9 | 0.9 | 0.9 | 0.9 |
| PHOSPHATE ESTER-TRITON H-55 | 0.4 | | | | 0.2 | | | | | | .72 | 1.8 | | | | | | | | | | |
| DIETHYLENE GLYCOL MONO METHYL ETHER | | 0.1 | | | 0.1 | 0.1 | | | | | | | | | | | | | | | | |
| ETHOXYLATED ALKYL PHENOL | 0.2 | 0.5 | 0.5 | 0.6 | 0.5 | 0.6 | 0.6 | 0.6 | 0.6 | 0.6 | .24 | | 0.6 | 0.6 | 0.6 | 0.6 | 0.6 | 0.6 | 0.6 | 0.6 | 0.6 | 0.6 |
| EMEREST 2647 - ETHOXYLATED FATTY ACID ESTERS | | | | .15 | | .15 | .15 | .15 | .15 | .15 | | | .15 | .15 | .15 | .15 | .15 | .15 | .15 | .15 | .15 | .15 |
| SODIUM FATTY ACID | 0.2 | 0.2 | 0.2 | | | | | | | | | | | | | | | | | | | |

-continued

| EXAMPLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|---|---|---|---|
| ETHER SULFATE | | | | | | | | | | | | | | | | | | | | | | |
| SODIUM LINEAR ALKYL BENZENE SULFONATE (ACTIVE) | 0.2 | | | | | | | | | | | 0.6 | | | | | | | | | | |
| OPTICAL BRIGHTENER | | | | | | | | | | | | | | | | | | | | .02 | | |
| IPA | 1.0 | 1.5 | 2.0 | 2.7 | 2.0 | 2.0 | 1.3 | | | 2.7 | | | 2.7 | 2.7 | 2.7 | 2.7 | 2.7 | 2.7 | 2.7 | 2.7 | 2.7 | 2.7 |
| ACETONE | 1.0 | | | | | | | 2.5 | | | | | | | | | | | | | | |
| ETHYLENE MONO BUTYL ETHER | | 0.5 | | | | | | | | | | | | | | | | | | | | |
| DIETHYLENE GLYCOL MONO METHYL ETHER | | | | | | | 1.45 | | 2.5 | | | | | | | | | | | | | |
| DIETHYLENE GLYCOL MONO BUTYL ETHER | | | | | | | | | | | | | | | | | | | | | | |
| POTASSIUM HYDROXIDE | | | | | | | | | | | | | | | | | | | | | | |
| WATER (BALANCE) | | | | | | | | | | | | | | | | | | | | | | |

The acoustic material such as porous acoustic tile is initially brushed and/or vaccumed. The cleaning solution is prepared from the concentrate and dry ammonium persulfate, and then applied to the physically cleaned tiles, preferably by spraying. With the exception of metal fittings that may catalyze the decomposition of the persulfate, such as mild steel, copper, copper alloys, nickel, etc., the same spraying equipment may be used as that for chlorine, thus obviating the need for new equipment. The detergent and solvent action of the cleaning solution will loosen the dirt from the tile surface and then redistribute the dirt over the tile in an even manner. This facilitates a uniform oxidation of the dirt, tobacco and cooking residues, etc., by the persulfate and conversion of these materials to a neutral color. The tiles are then simply allowed to dry.

When applying the aqueous cleaning solution containing persulfate, it is preferred to avoid direct contact with the spray, and use of common painter's spray or dust goggles and face mask, and possibly rubber gloves is accordingly recommended. However, unlike chlorine, the spray of this invention does not pose a problem to persons outside the work area because it is not disseminated as hazardous gas, with the exception of minor amounts of solvent.

Obviously, various embodiments of this invention are possible without departing from the inventive spirit thereof. For example, if the tap water is of very good quality and low hardness, the use of a chelating agent may be reduced below the specified concentration levels. Furthermore, the amount of phosphate ester (or similar) surfactant used as the hydrotrope may be increased beyond the concentration limits shown and thereby function partly or completely in place of the polyoxyethylene-9-octyl (or nonyl) phenol surfactant. Also, if the acoustic tiles are extremely dirty, a stronger concentration of persulfate, or higher pH may be used, or a second application of the cleaning solution might be necessary. If desired, an optical brightener and corrosion inhibitors may be added such as benzotriazole, sodium nitrite, sodium metasilicate, sodium benzoate, etc. Commercially available optical brighteners that are alkali stable may be used, such as CONCOFLOR 900 or CONCOFLOR DG69 sold by Continental Chemical Co., and Hiltamine Arctic White CWD made by Hilton Davis. Alkali metal or ammonium salts of salicylic acid are also useful.

I claim:

1. A method for cleaning acoustic material with a water soluble oxidizing agent selected from the class consisting of ammonium persulfate and alkali metal persulfate, comprising the steps of: (i) forming a stable, aqueous first solution containing the following components: a cleaning detergent, a soil suspender a solvent, a chelating agent, a pH adjusting agent, and a hydrotrope to maintain the aqueous solution in a single phase, and to stabilize a solution of the oxidizing agent when combined with the solution of the said components; (ii) converting the oxidizing agent from a solid form into an aqueous solution; (iii) mixing the solution of the said components and the oxidizing solution to form a cleaning solution having a stability period of at least about 5 to 10 days, the cleaning detergent being non-reactive with the oxidizing agent, and the pH adjusting agent being present in sufficient quantity to adjust the cleaning solution pH to at least about 8–9; (iv) physically removing a portion of dirt material from the acoustic material; and, (v) applying the cleaning solution to the acoustic material during the stability period to partially dissolve, and redistribute the dirt to a neutral color, and allowing the solvent and water to evaporate.

2. The method of claim 1, in which the components and oxidizer are contained in the cleaning solution in the following approximate concentrations:

| | |
|---|---|
| (a.) inorganic persulfate | 2.0%–10%; |
| (b.) chelating agent | 0.03%–0.3%; |
| (c.) inorganic soil suspender | 0.1%–4.0%; |
| (d.) hydrotrope | 0.5%–3.0%; |
| (e.) a cleaning detergent | 0.5%–4.0%; |
| (f.) water miscible solvent | 1.0%–6.0%; |
| (g.) $H_2O$ of portable quality | dilution to balance. |

3. The method of claim 2, in which the components and oxidizer are contained in the cleaning solution in the following approximate concentrations:

| | |
|---|---|
| (a.) inorganic persulfate | 5.0%–7.0%; |
| (b.) chelating agent | 0.05%–0.1%; |
| (c.) inorganic soil suspender | 0.2%–0.5%; |
| (d.) hydrotrope | 0.8%–1.3%; |
| (e.) surfactant or emulsifier | 0.5%–1.5%; and, |
| (f.) water miscible solvent | 1.5%–3.5%. |

4. The method of claim 3, in which the components and oxidizer are contained in the cleaning solution as follows:

(a) the inorganic persulfate is selected from the class consisting of ammonium persulfate, sodium persulfate and potassium persulfate;

(b) the soil suspender is selected from the class comprising tetrapotassium pyrophosphate, sodium tri polyphosphate, Na or K hexametaphosphate, and Na or K silicates;

(c) the hydrotrope is selected from the class comprising Na or K xylene sulfonate, phosphate ester surfactants, and mixtures thereof;

(d) the surfactant or emulsifier is selected from the class consisting of ethoxylated alkyl phenols, ethoxylated fatty acid esters, ethoxylated alcohols, fatty acid sulfates and ether sulfates;

(e) the solvent is selected from the class consisting of: isopropyl alcohol, ethyl alcohol, acetone, methyl ethyl ketone and ethylene glycol monobutyl ether; and, (f) the pH adjusting agent is selected from the class consisting of KOH, NaOH, and mixtures thereof.

5. The method of claim 4, in which following mixing of the components and solution of the oxidizing agent, the cleaning solution is applied to the acoustic material by spraying.

6. A cleaning solution for acoustic material, the cleaning solution containing an oxidizing agent selected from the class consisting of ammonium persulfate and alkali metal persulfates, comprising the following components:

| | | |
|---|---|---|
| (a) a solution of the said oxidizing agent | about | 2.0%-10%; |
| (b) chelating agent | about | 0.03%-0.3%; |
| (c) inorganic soil suspender | about | 0.1%-4.0%; |
| (d) hydrotrope | about | 0.5%-3.0%; |
| (e) a cleaning detergent | about | 0.5%-4.0%; |
| (f) water miscible solvent | about | 1.0%-6.0%; |
| (g) $H_2O$ of potable quality | about | dilution to balance; |

the hydrotrope being adapted to maintain the aqueous solution in a single phase, and to stabilize a solution of the oxidizing agent when combined with the solution of the said components, and a pH adjusting agent being present in sufficient quantity to adjust the cleaning solution pH to at least about 8-9; the solution of the said components and the oxidizing solution forming the cleaning solution having a stability period of at least about 5 to 10 days, the cleaning detergent being nonreactive with the oxidizing agent.

7. The cleaning solution of claim 6, in which the components and oxidizer are contained in the cleaning solution in the following approximate concentrations:

| | |
|---|---|
| (a.) inorganic persulfate | 5.0%-7.0%; |
| (b.) chelating agent | 0.05%-0.1% ; |
| (c.) inorganic soil suspender | 0.2%-0.5%; |
| (d.) hydrotrope | 0.8%-1.3%; |
| (e.) surfactant or emulsifier | 0.5%-1.5%; and, |
| (f.) water miscible solvent | 1.5%-3.5%. |

8. The cleaning solution of claim 7, in which the components and oxidizer are contained as follows:

(a) the inorganic persulfate is selected from the class consisting of ammonium persulfate, sodium persulfate and potassium persulfate;

(b) the soil suspender is selected from the class comprising tetrapotassium pyrophosphate, sodium tripolyphosphate, Na or K xylene sulfonate, phosphate ester surfactants, and mixtures thereof.

(c) the surfactant is selected from the class comprising ethoxylated alkyl phenols, ethoxylated fatty acid esters, ethoxylated alcohols, fatty acid sulfates and ether sulfates;

(d) the hydrotrope is selected from the class comprising Na or K xylene sulfonate, phosphate ester surfactants, and mixtures thereof;

(e) the solvent is selected from the class consisting of: isopropyl alcohol, ethyl alcohol, acetone, methyl ethyl ketone and ethylene glycol monobutyl ether: and, (f) the pH adjusting agent is selected from the class consisting of KOH, NaOH, and mixtures thereof.

9. The cleaning solution of claim 8, in which the oxidizing agent is ammonium persulfate; the chelating agent is hydroxyethyl ethylene diamine triacetic acid trisodium salt; the soil suspender is tetrapotassium pyrophosphate; the hydrotrope is Na or K xylene sulfonate, a phosphate ester surfactant or mixtures thereof; the surfactant or emulsifier is a polyoxyethylene octyl (or nonyl) phenol or a polyethylene glycol sesquioleate; the solvent is isopropyl alcohol; and, the pH adjusting agent is KOH.

10. The cleaning solution of claim 6, including alkali metal or ammonium salts of salicylic acid as a brightening agent.

11. The cleaning solution of claim 6, in which the soil suspender is an inorganic polyphosphate.

12. The cleaning solution of claim 6, in which the chelating agent is a compound selected from the class consisting of: nitriloacetic acid derivatives, polyamino carboxylic acid salts, salts of oxycarboxylic acids, and the soil suspender is an inorganic polyphosphate.

* * * * *